US012509823B2

(12) United States Patent
Gscheider

(10) Patent No.: US 12,509,823 B2
(45) Date of Patent: Dec. 30, 2025

(54) SCREEN PLATE AND PULP SCREENING MACHINE

(71) Applicant: ANDRITZ (China) Ltd., Guangdong (CN)

(72) Inventor: Alexander Gscheider, Hohentauern (AT)

(73) Assignee: ANDRITZ (China) Ltd., Guangdong (CN)

( * ) Notice: Subject to any disclaimer, the term of this patent is extended or adjusted under 35 U.S.C. 154(b) by 655 days.

(21) Appl. No.: 17/896,499

(22) Filed: Aug. 26, 2022

(65) Prior Publication Data

US 2023/0060403 A1 Mar. 2, 2023

(30) Foreign Application Priority Data

Sep. 1, 2021 (CN) ..... 202111021314.6

(51) Int. Cl.
*D21D 5/04* (2006.01)

(52) U.S. Cl.
CPC ..... *D21D 5/04* (2013.01)

(58) Field of Classification Search
CPC ..... D21D 5/04
USPC ..... 162/232
See application file for complete search history.

(56) References Cited

U.S. PATENT DOCUMENTS 5,192,438 A * 3/1993 Frejborg ..... D21D 5/16 209/273
7,987,991 B2 8/2011 Piper et al.
2005/0183993 A1* 8/2005 Gabl ..... D21D 5/04 209/44

FOREIGN PATENT DOCUMENTS

CN 102154912 A 8/2011
DE 8909871 U1 10/1989
GB 2195911 A 4/1988

OTHER PUBLICATIONS

European Search Report dated Jan. 16, 2023 for European Patent Application No. 22189468.6.

* cited by examiner

*Primary Examiner* — Jacob T Minskey
(74) *Attorney, Agent, or Firm* — Alix, Yale & Ristas, LLP

(57) ABSTRACT

A screen plate for a pulp screening machine. On the side towards the rotor of the pulp screening machine, the screen plate has concave grooves. Except in the region of the grooves, an even gap is formed between the vane of the rotor and the surface of the screen plate, wherein the rotor vane front edge of the pulp screening machine is arranged at an angle to the grooves. Also, a pulp screening machine with the screen plate.

18 Claims, 1 Drawing Sheet

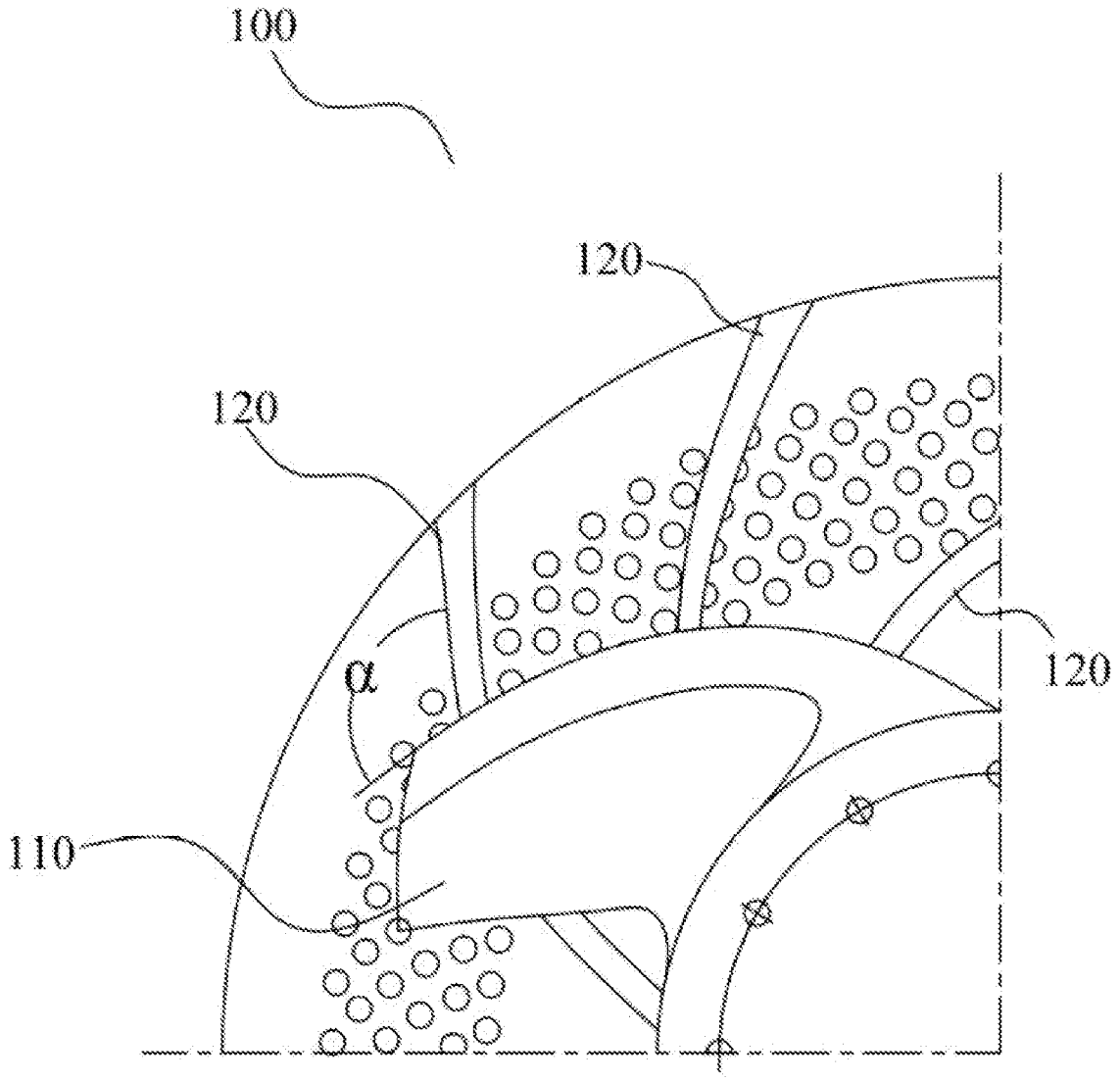
100
120
120
120
α
110

SCREEN PLATE AND PULP SCREENING MACHINE

BACKGROUND

The disclosed embodiments relate to a screen plate for a pulp screening machine, and additionally to a pulp screening machine with said screen plate.

There are usually welded or bolted (or a combination of both) wear strips on the surfaces of screen plates on pulp screening machines. The wear strips form as strip type projections to provide a cleaning function as well as a de-flaking function within the respective machine.

Drawbacks of such wear strips on the screen plate are that they wear out rather quickly, and the rotor must maintain a certain gap to the wear strips during assembly, which therefore results in an even larger gap between the rotor and the surface of the main body of the screen plate. Such a gap reduces screen plate cleaning efficiency, throughput, and de-flaking rate.

SUMMARY

Disclosed herein are embodiments of a screen plate on a pulp screening machine that eliminate the shortcomings of the state of the art. The screen plate has concave grooves on the side of the main body facing towards the rotor of the pulp screening machine, wherein except in the grooved region, the rotor vane builds an even gap to the surface of the screen plate, wherein the rotor vane front edge of the pulp screening machine is arranged at an angle to the grooves.

Such grooves are arranged on the screen plate of the disclosed embodiments instead of conventional strip type projections as known in the art. Herein the grooves are not through grooves, but build up concave forms, in which the groove bottoms are slightly lower than the main body of the screen plate surface. Using grooves instead of projections allows a minimalization of the gap between the rotor and the surface of the screen plate, which increases the cleaning efficiency of the screen plate, throughput/yield of the pulp screening machine, as well as increases de-flaking efficiency. The smaller the gap between the rotor vanes and the surface of the screening plate outside the area of the grooves, the fewer impurities can enter into the gap between the rotor vanes and the screen plate, thus reducing wearing and improving life of the rotor and the screen plate.

An "even gap" formed between the grooved region and the surface of the screen plate means that except in the grooved region there is no substantial break, indentation, projection, or irregularity on the surface of the screen plate relative to the rotor. There might be slight difference in the width of gap occasionally, or even inclination, so long as such difference is an allowable tolerance in the conventional art. A purpose of replacing the conventional strip type projections on the screen plate with the grooves therein is to minimize the width of the gap. It is even possible for a technical solution with some protrusions on the screen plate to be regarded as an "even gap" as defined herein, as long as such protrusions do not substantially increase the width of the gap between the rotor vane and the surface of the screen plate.

According to one of the preferred embodiments, the grooves are designed to form angles greater than 90° relative to the front edge of the rotor vane along the entire length of the grooves, so as to avoid wedging-in of the impurities and facilitate the de-flaking of the impurities.

According to one of the preferred embodiments, the width of the grooves increases from a position at the center of the screen plate toward the outside of the screen plate. Due to the "wiping effect", the amount of collected impurities on the rotor vane front edge increases from inside of the screen plate to the outside. The increased width of the grooves from the center of the screen plate to the outside adapts to such increasing amount of collected impurities.

According to one of the preferred embodiments, the depth of the grooves increases from a position at the center of the screen plate toward the outside of the screen plate. Due to the "wiping effect", the amount of collected impurities on the rotor vane front edge increases from inside of the screen plate to the outside. The increased depth of the grooves from the center of the screen plate to the outside adapts to such increasing amount of collected impurities.

According to one of the preferred embodiments, the width and the depth of the grooves increases from the center of the screen plate to the outside. Due to the "wiping effect", the amount of collected impurities on the rotor vane front edge increases from inside of the screen plate to outside. The increased width and depth of the grooves from the center of the screen plate to the outside adapts to such increasing amount of collected impurities.

According to one of the preferred embodiments in the present invention, the grooves have a larger width at their openings than at their bottoms. With such a groove design, fewer impurities are accumulated within the grooves.

According to one of the preferred embodiments, the screening plate is flat.

Preferably, both longitudinal ends of the grooves are open, so that the center of the screen plate is in communication with its peripheral region.

According to one of the preferred embodiments, the screen plate is curved.

Preferably, the screen plate is the cylindrical surface of the cylindrical screen basket.

Preferably, the screen plate is the conical surface of the conical screen basket.

Preferably, the screen plate (100) is perforated or slotted, whether it is flat or curved.

The present invention also provides a pulp screening machine comprising a rotor and an embodiment of the above described screen plate.

BRIEF DESCRIPTION OF THE DRAWINGS

FIG. 1 schematically shows a partial section view of an embodiment of the screen plate positioned relative to a rotor.

DETAILED DESCRIPTION

FIG. 1 schematically shows a preferred embodiment of the disclosed screen plate 100 in relation to a rotor 110 of a pulp screening machine. The screen plate 100 has a main body with concave grooves 120 on the side towards the rotor 110 of the pulp screening machine. Except in the region of the grooves 120, an even gap is formed between the vane of the rotor 110 and the surface of the screen plate 100 that faces the rotor 110. As shown, the concave grooves 120 of the screen plate 100 are configured to form an angle $\alpha$ greater than 90° relative to the front edge of the rotor vane along the entire length of the grooves (120). For example, FIG. 1 shows that three grooves intersect with the front edge of the rotor vane, and the angles formed by grooves and the front edge of the rotor vane are all greater than 90° at every intersection point.

As shown, the width of each of the grooves 120 increases from the center of the screen plate toward the outside (the curved edge shown in FIG. 1). The screen plate 100 is flat and both longitudinal ends of the grooves 120 are open, so as to provide communication between the center of screen plate 100 and its peripheral region.

The advantages of the inventive embodiments disclosed herein are as follows: the grooves provided instead of projections as known in the art allows a minimization of the gap between the rotor and the screen plate, which increases de-flaking efficiency as well as capacity. This reduces buildup of impurities, especially larger impurities, because it is hard for the impurities to stay between the rotor and the screen plate, and the smaller gap restricts impurities from entering the gap. Accordingly, power consumption of the pulp screening machine decreases. Additionally, the lower amount of impurities entering into the gap between the rotor and the screen plate, wearing is reduced accordingly.

Alternatively, in an embodiment not shown, the surface of the screen plate can be configured to have a curved surface. For example, the screen plate may form a cylindrical surface of a cylindrical screen basket or a conical surface of a conical screen basket. Using grooves instead of projections on any shapes of screen plate yields the same advantages and improvements described above.

Moreover, although FIG. 1 depicts a screen plate 100 with holes on the surface, it could be understood that said screen plate may also be a slotted screen.

The above discloses the preferable embodiments of this invention, while the spirit and scope of this invention are not limited within the specific contents disclosed here. Those skilled in the art can develop more embodiments and applications according to teaching of this invention, and these embodiments and applications also belong to the spirit and scope of this invention. Therefore, it could be understood that the specific embodiments of this invention do not further limit the spirit and scope of this invention, which is defined by the claims.

REFERENCE NUMBER LIST

100 screen plate
110 rotor vane
120 groove
$\alpha$ the angle between the groove and the rotor vane front edge

What is claimed is:

1. A screen plate (100) for a pulp screening machine having a rotor (110) with a vane having a front edge, comprising:

a main body; and concave grooves (120) on the main body on a surface of the screen plate (100) towards the rotor (110) of the pulp screening machine, each concave groove (120) extending across a length between a bottom end and a top end, wherein the screen plate (100) is configured to be arranged to provide an even gap between the vane of the rotor (110) and the surface of the screen plate (100) toward the rotor except in a region with a groove (120), and with the front edge of the vane of the rotor (110) at an angle to the length of each of the grooves (120), and the concave grooves (120) of the screen plate (100) are configured and positioned to form angles of greater than 90° relative to the front edge of the rotor vane across the entire length of the respective grooves (120).

2. The screen plate (100) according to claim 1, wherein each of the grooves (120) has a width that increases from a center portion of the screen plate (100) toward an outer portion of the screen plate (100).

3. The screen plate (100) according to claim 1, wherein each of the grooves (120) has a width that increases from a center portion of the screen plate (100) toward an outer portion of the screen plate (100).

4. The screen plate (100) according to claim 1, wherein each of the grooves (120) has a depth that increases from a center portion of the screen plate (100) to an outer portion of the screen plate (100).

5. The screen plate (100) according to claim 1, wherein each of the groves (120) has a width and a depth that increases from a center of the screen plate (100) to an outer portion of the screen plate (100).

6. The screen plate (100) according to claim 1, wherein each of the groves (120) has a width and a depth that increases from a center of the screen plate (100) to an outer portion of the screen plate (100).

7. The screen plate (100) according to claim 1, wherein each of the grooves (120) has a width and an open top end at an outer portion of the screen plate (100), and for a given groove (120), the width at the open top end is greater than the width at the respective bottom.

8. The screen plate (100) according to claim 2, wherein each of the grooves (120) has a width and an open top end at an outer portion of the screen plate (100), and for a given groove (120), the width at the open top end is greater than the width at the respective bottom.

9. The screen plate (100) according to claim 2, wherein each of the grooves (120) has a width and an open top end at an outer portion of the screen plate (100), and for a given groove (120), the width at the open top end is greater than the width at the respective bottom.

10. The screen plate (100) according to claim 1, wherein the screen plate (100) is flat.

11. The screen plate (100) according to claim 10, wherein each of the bottom and top ends of the grooves (120) is open such that a center portion of the screen plate (100) is in communication with its peripheral region via the grooves (120).

12. The screen plate (100) according to claim 1, wherein the screen plate (100) is curved.

13. The screen plate (100) according to claim 12, wherein the screen plate (100) is a cylindrical surface of a cylindrical screen basket.

14. The screen plate (100) according to claim 12, wherein the screen plate (100) is a conical surface of a conical screen basket.

15. The screen plate (100) according to claim 1, further comprising perforations or slots.

16. A pulp screening machine, comprising:

a rotor (110) having a vane with a front edge, and a screen plate (100) having a main body and concave grooves (120) on the main body on a surface of the screen plate (100) towards the rotor (110), each concave groove (120) extending across a length between a bottom end and a top end, wherein the screen plate (100) is arranged to provide an even gap between the vane of the rotor (110) and the surface of the screen plate (100) toward the rotor except in a region with a groove (120), and with the front edge of the vane of the rotor (110) at an angle to the length of each of the grooves (120), and the concave grooves (120) of the screen plate (100) are configured and positioned to form angles of greater than 90° relative to the front edge of the rotor vane across the entire length of the respective grooves (120).

17. The pulp screening machine of claim 16, wherein each of the grooves (120) has a width and an open top end at an outer portion of the screen plate (100), and for a given groove (120), the width at the open top end is greater than the width at the respective bottom.

18. The pulp screening machine of claim 16, wherein each of the bottom and top ends of the grooves (120) is open such that a center portion of the screen plate (100) is in communication with its peripheral region via the grooves (120).

* * * * *